United States Patent [19]

Fadner et al.

[11] Patent Number: 4,767,119

[45] Date of Patent: Aug. 30, 1988

[54] PEELABLY ADHESIVE GAME BOARD

[76] Inventors: Thomas A. Fadner, 1084-64th St., Apt. #6, LeGrange, Ill. 60525; Nancy J. Linton, Rte. 1, Box 317, Vulean, Mich. 49892

[21] Appl. No.: 940,432

[22] Filed: Dec. 11, 1986

[51] Int. Cl.[4] ..... A63F 3/06

[52] U.S. Cl. ..... 273/148 A; 40/594; 273/282

[58] Field of Search ..... 273/148 R, 148 A, 150, 273/269, 282 A, 309; 40/594, 595

[56] References Cited

U.S. PATENT DOCUMENTS 2,872,215 2/1959 Taylor ..... 273/309
2,914,873 12/1959 Brennan ..... 40/594
3,466,217 9/1969 Mott ..... 40/594 X
3,836,151 9/1974 Bowerman ..... 273/282 A
4,133,536 1/1979 Cole ..... 273/309 X

*Primary Examiner*—Anton O, Oechsle
*Attorney, Agent, or Firm*—James E. Nilles

[57] ABSTRACT

A convenient, foldable game board for holding game cards for Bingo and similar games, wherein the cards are temporarily adhered to the board and can be peeled off and removed or replaced by the player. Various means are disclosed for peelably adhering the cards to the board. These include tacky substances applied to the board or applied to the cards, non-tacky liquid substances which migrate to the surface of the board to provide temporary adhesion and non-tacky latently adhesive coacting material pairs.

10 Claims, 4 Drawing Sheets

PEELABLY ADHESIVE GAME BOARD

BACKGROUND OF THE INVENTION

This invention relates to novel means for persons to utilize multiple playing cards while playing games such as Bingo which employ such cards, and in particular to peelable releasably adhesive boards for mounting such cards, including means for replenishing the release or adhesive property of such boards.

In the practice of Bingo, players typically acquire multiple numbers of cards, at times ten or twenty or more, then carefully align them in convenient view and proximity on a game table that accommodates numerous other players. During play of the game, the individual players rapidly scan each letter category for each called number that appears on each of his/her game cards in each letter category.

Handling large numbers of game cards requires affixing them in some manner to avoid inadvertent disruption or skewing of the cards from their intended positions, such as by contact with clothing, bumping the game table, and the like. Typically, Bingo players will use more-or-less fast-drying glues applied from dispensers to affix the game cards directly onto a paper cover overlaying the table surface before play of the game commences. This practice serves to avoid inadvertent misplacement or displacement of game cards at inopportune moments during play. It does not allow replacement of one or more cards to a new position, nor does this allow convenient rapid, simultaneous removal of all markers after each game. In addition, no means is supplied to avoid overall disruption of a player's whole set of playing markers or chips if the paper table cover is inadvertently disrupted. Nor in the present practice of the game can one or more cards be shifted or interchanged to some new, moreadvantageous, fixedly-held position.

In the current art of Bingo game play when too much glue is applied to the cards or to the table paper the playing area may become unnecessarily messy. It too little glue is applied in only a few spots on the back of game cards, the cards may shift, curl, or otherwise cause interference with smooth, troublefree play of the game.

The use of pressure-sensitive tapes such as those marketed by 3M Company, St. Paul, Minn. to affix the game cards avoids most of the inadvertent misplacement during play of the game but is an expensive means for avoiding this problem, as the tape is not reusable. A disadvantage if the player wants to rearrange the game cards is that the cards remain permanently affixed.

In the patent granted to Nemec, U.S. Pat. No. 2,784,973, there is disclosed a novel game board for using more-or-less stiff, lightweight Bingo game cards of the type commonly used in playing parlor-type games of Bingo. No provision is disclosed for holding the game cards in place, or for using modern, disposable Bingo sheets printed on thin sheets of paper such as newsprint. And because the design is cumbersome, no more than six game cards could be accommodated, making this invention useless to the modern, large volume Bingo player.

In Taylor, U.S. Pat. No. 2,872,215, a Bingo card holder is disclosed to be made of flexible folded plastic with pouches into which Bingo cards can be inserted. While this patent claims simplicity of construction, it requires numerous small parts to form the pouches, stiffeners to prevent curl of the plastic, and frictional members in the pouches to hold the cards in place. In addition, each fold increases the thickness of the holder, making it unwieldy in the extreme.

This invention relates to solutions to the problems raised by these devices and methods.

SUMMARY OF THE INVENTION

The invention provides a large, flat, foldable game playing board, generally similar to that used in the well-known games of Monopoly marketed by Parker Brothers or Stock Market marketed by Western Printing Company, Racine, Wis. The dimensions of the game board are selected to be suitable for affixing thereto an appropriate number of standard Bingo game-playing cards in flat, more-or-less adjoining positions for play of the game. The board is constructed of a convenient thickness of paper or plastic material to supply stiffness that avoids warpage or inadvertent bending and freedom from easily-damaged edges during use in playing the game and during storage of the board by the game player. Means for peelably affixing game cards to the board are provided such that the player is allowed to advantageously align the cards and fix their positions during play. Subsequently, the player can remove the cards in a manner that allows multiple reuse of the game board.

Accordingly, it is an object of this invention to facilitate a Bingo player's capability for scanning and thereby effectively utilizing multiple game cards simultaneously, for instance twelve or more, between each number call during play of the game.

Another object of this invention is to increase the number of game cards that a player can accommodate simultaneously during play of the game.

A further object of this invention is to reduce the errors made during play of the game by avoiding accidental displacement of one or more game cards from selected, advantageous playing card viewing positions.

Yet another object is to allow a player to rapidly, simultaneously and conveniently empty or remove all of the game chips or markers from all of the game cards at the end of each game without disrupting the advantageously-placed card positions.

It is also an object of this invention to allow simple replacement or repositioning of any or all of a player's game cards, for instance between games of a set, at the player's discretion, without materially affecting the fixedly-placed positions of the remaining game cards.

Another object of this invention is to provide an inexpensive, foldable, permanent, attractive, game board having convenient surface elements for fixedly attaching game cards prior to play of the game and means for stripping or removing said cards from said game board that allows multiple reuse and convenient storage of said game board.

Other objects and advantages of this invention will become apparent hereinafter.

DESCRIPTION OF THE PREFERRED EMBODIMENTS

Overview

Figure 1:
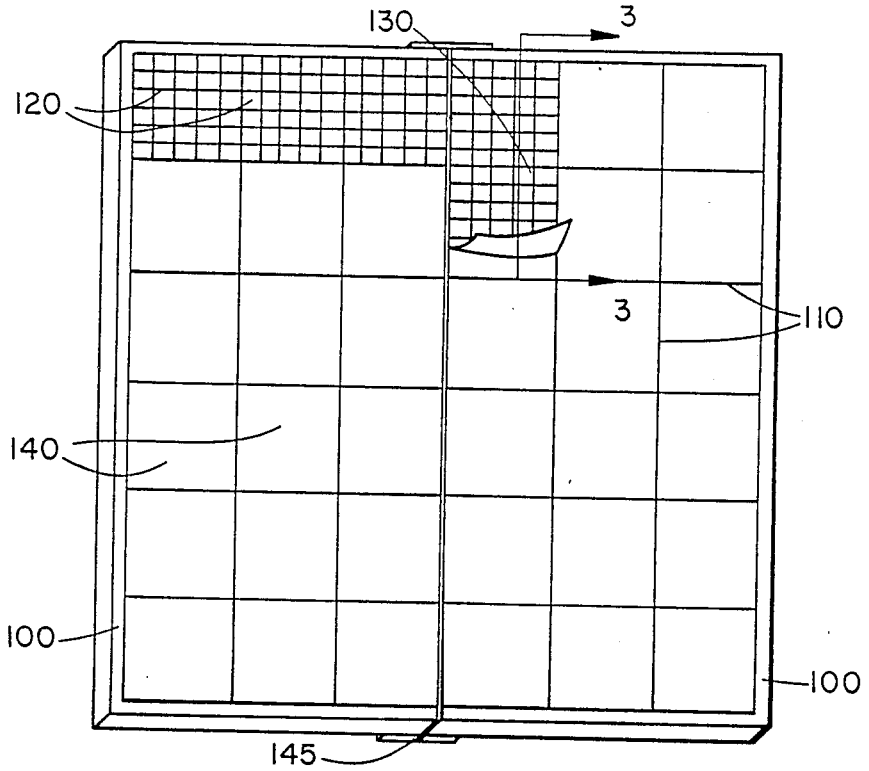
FIG. 1 is a top view of one embodiment of the invention.

Referring to FIG. 1, an embodiment constructed according to the instant invention is shown in the flat, open, playing position. This embodiment includes two board sections 100 of more or less stiff paperboard or plastic, suitably printed or illustrated with lines 110 to indicate positions for affixing Bingo cards, with several cards 120 shown in position and one card 130 partially in position on the playing surface 140. A hinge 145 holds the separate board sections 100 together and allows folding.

Figure 2:
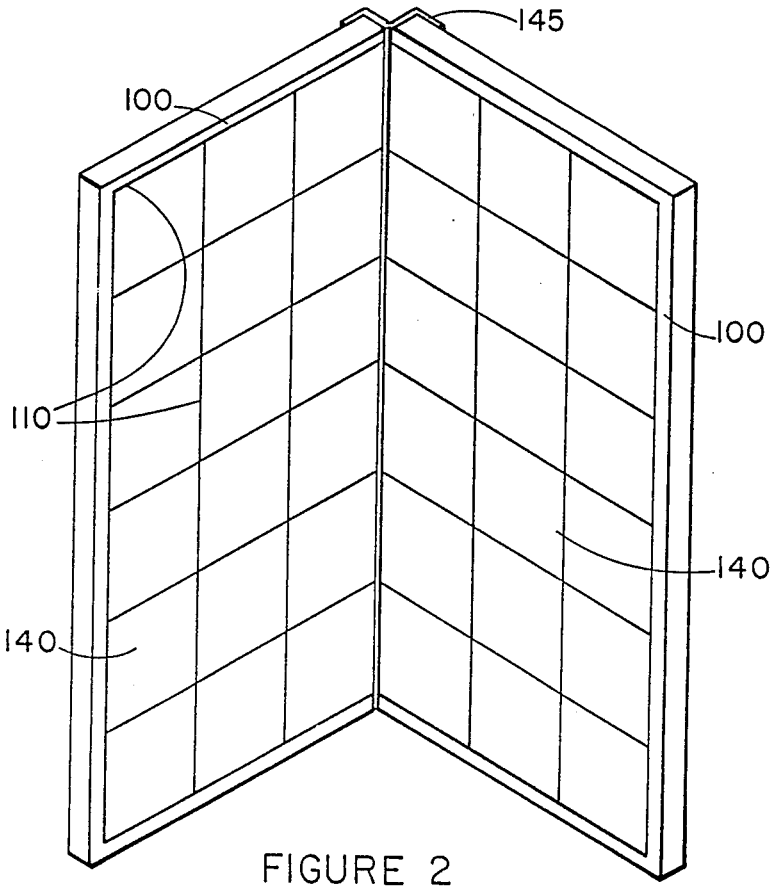
FIG. 2 is a view of the embodiment of FIG. 1, shown partially folded.

FIG. 2 shows the game board sections in a partially folded position. The game board may include one or more sections 100 suitably hinged to be folded such that the outside of the board acts as a protective cover for the playing surface when the hinged game board is folded for storage. The board may be V-folded as shown in FIG. 2. Alternatively, it could be printed on one of the two sides only, and folded together. Also, it could be printed in three elements, as in the well-known C-shape, in four elements, as in the well-known W-shape, or in any shape which can be folded such that the playing surface is inside and not exposed when folded.

An important element of this invention is the concept of fixedly and peelably holding the game game cards in place on the game board surfaces during play of the game. The peelable feature allows complete or substantially complete removal of the game cards at a player's discretion, for instance at the end of play, without materially affecting the nature of the uppermost surface of the game board, thereby allowing multiple peelable reuse of the game board elements herein disclosed.

Any of several means may be used to accomplish temporary but secure fixing of the game cards to the game board, each means having certain slight advantages characteristic of the particular means employed.

Applying Adhesive to Reverse Side of Game Cards

Figure 3:
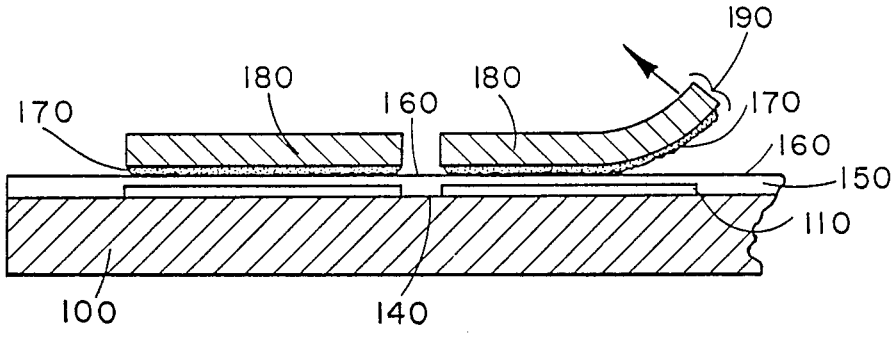
FIG. 3 is a sectional view of FIG. 1 taken along line 3—3.

In the embodiment shown in FIG. 3, the printed game board may include several foldable elements illustrated by member 100. Member 100 is made of paperboard, plastic or other suitable base material as is well known in the art of game board construction. The printed or playing surface 140 is varnished or suitably coated with a substantially clear organic polymeric overprint coating 150 typical of coating materials used in the art of game board manufacture to protect the game board playing surfaces and the printed graphics 110 thereon, except that the coating for the practice of this invention contains one or more release agents selected from those known in the art of releasable adhesion such as silicone fluids, polymeric silicones, powdered polethyelenes, powdered polyfluorocarbons, synthetic and natural waxes and the like, and combinations of these, thereby forming release surface 160 on overprint coating 150. A permanently pressure-sensitive liquid adhesive 170 is supplied with the game board contained in a suitably-convenient dispenser from which the game player applies said adhesive, as shown in FIG. 3, to the reverse side of each playing card 180. The adhesive-backed game cards 190 may then be positioned on the release-coated playing surface 160 of the game board 100, for instance in positions corresponding to placement lines previously printed 110 on the playing side of the game board, prior to the beginning of play, thereby adhesively attaching the cards to the board as shown in FIGS. 1 and 3 and fixedly holding the cards to the board during play of the game.

The release surface 160 allows the game player to willfully peel one or more adhesive-backed game cards 190 away from the playing surface, as shown in FIG. 3 for instance to reposition them at the player's discretion to "change his luck." Removal of all the previously-placed game cards and removal thereby of all of the previously-placed adhesive renders the release-playing surface 160 of the game board 100 ready to accept a new set of game cards, for instance at the next round or set of games.

It will be apparent to those skilled in the art of adhesive and release materials that the aforementioned adhesive/release cooperating or coacting properties can be regulated and controlled by appropriate selection from among existing commercially-available materials and methods of application and thereby impart the temporary but readilypeelable adhesiveness characteristics that are advantageous in the practice of this invention. Illustrative but not limiting examples of adhesives useful in the practice of this embodiment are Hycar 2110, B. F. Goodrich Co., Cleveland OH, which has low peel strength and therefore easily removed from the release-agent-containing playing surface; Amsco PSA 9201, Union Chemicals Division, Schaumburg, IL which is an acrylic copolymer emulsion formulated to not leave residual adhesive when peeled from the opposite surface; Amoco PSA 9204 an acrylic copolymer emulsion formulated to have excellent adhesion to release-coated surfaces; Covinax 266 and Covinax 300, acrylic polymer emulsions supplied by Franklin Chemical Industries, Columbus, OH, which also have low peel strength for easy removal from the board surface. Illustrative but not limiting examples of suitable release agents are Dow Corning 200 Fluid, Dow Corning 1101 Emulsion, Dow Corning HV490 Silicon Emulsion, all distributed by Dow Corning Corporation, Midland MI.

Figure 4:
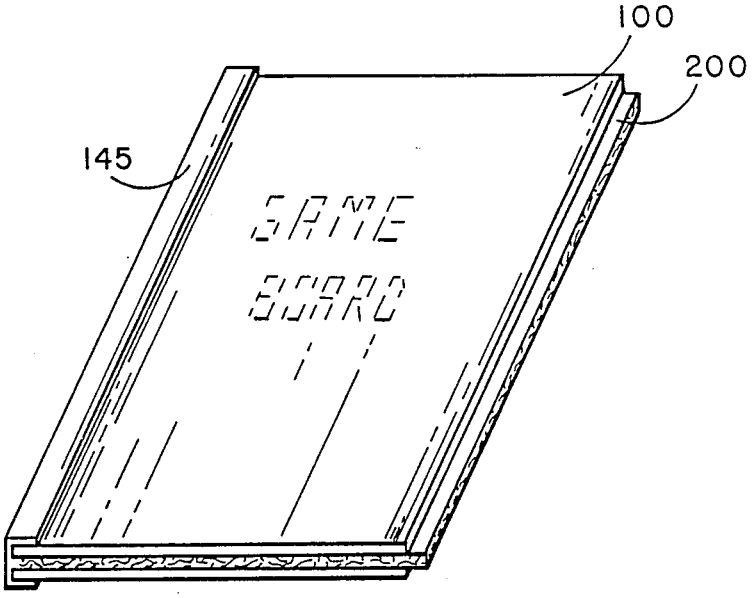
FIG. 4 is an isometric view of certain embodiments of FIG. 1, shown completely folded.

In another embodiment of the same invention, a game board 100 similar to that shown in FIG. 3 is constructed but without incorporating a release agent in the uppermost or varnish coating. The varnish coating 150 of FIG. 3 is selected for the usual clarity, mar-resistance, stain-resistance and other properties typically known to those skilled in the art of game board construction. A further property of this coating is that it be selected to be cooperative towards the attachment, penetration, or migration of a release agent applied by external means to its surface. Referring to FIG. 4, a paper or tissue or other suitable sheetlike material 200 impregnated with a fugative, migratable release agent such as silicones, fluorocarbons, waxes or oils is supplied with the game board. This impregnated sheet is maintained between the folded game board, for instance during storage as shown in FIG. 4, thereby imparting or replenishing release propensity to the surface of the game board by migration of release agent material from the sandwiched release-agent-impregnated sheet onto and/or into the playing surface layers of the game board. The release property thereby imparted to the playing surface of the game board allows for coacting adhesive/-release pairs that peelably affix game cards to the game board, substantially as described in first reference to FIG. 3.

Yet another embodiment can be disclosed by reference to FIG. 3, where, instead of having the player apply liquid adhesive by use of a dispenser as first described with respect to this figure, two-sided pressure-sensitive adhesive tape 170 is supplied along with the printed varnished game board 100. The varnish 150 contains a release agent more-or-less selected from the release agent materials first named, thereby forming the poorly-adhesive surface 160. The supplied two-sided adhesive-tape thereby adheres fixedly but peelably to the game board surfaces. As illustrated in FIG. 3, the two-sided tape is used by the game player to affix the game cards firmly but temporarily to the game board surfaces, the adhesive 170 of the tape thereby being removable substantially completely along with the willful peelable removal of spent game cards 180 at the end of game play, leaving the game board surfaces 160 clean and free of adhesive or paper debris, ready for foldable storage and for subsequent reuse in another game set.

The two-sided pressure-sensitive adhesive tape can advantageously be supplied in a roll of convenient width, for instance one-half inch, and/or in a dispenser fitted with a cutting edge similar to those marketed by 3M Company, St. Paul, Minnesota and others. The game player can thereby dispense convenient lengths of tape for application to the game cards 180 thence to the game board surface 160 as shown in FIG. 3 or the tape can be supplied in suitable precut appropriately-dimensioned pieces.

The components for the game board coating 150 are advantageously selected to form a coating surface 160 that is washing-resistant, for instance to household soap and water, such that the game player may easily and conveniently remove by simple washing action the last vestiges of tacky tape material or paper fiber debris that may inadvertently remain or may be inadvertently impressed into the game board's uppermost surface-coating.

A further embodiment can be shown by further reference to FIG. 3. In this embodiment an adhesively coacting set of materials is employed in a manner similar to that first described in reference to FIG. 3 except that the overprint varnish or clear playing side coating 150 of the game board 100 is the first of an adhesively-coacting set of polymeric materials and the more-or-less permanently pressure-sensitive adhesive 170 that is used by the player to attach the game cards 180 is the second of the coacting set which adheres or bonds temporarily or peelably only when pressed against the coacting first surface of the game board. Reference is made for illustrative purposes to self-sealing envelopes wherein tackiness or adhesion is developed only when the two coacting, non-tacky surfaces are pressed together. Adhesiveness of these coacting pairs can be adjusted by simple formulation art known by suppliers of said materials so that the peelable release feature is retained. An illustrative but not limiting example of a cold-seal cohesive adhesive is Crimpband B7075X-1 available from Pierce and Stevens Co., Buffalo NY with which coated surfaces bond to themselves under pressure but do not stick to other surfaces.

A still further embodiment can be shown by further reference to FIG. 3. In this embodiment an adhesive/-release coacting set of materials is employed in a manner similar to that first described in reference to FIG. 3 except that the overprint varnish or clear playing-side coating 150 of the game board 100 contains a slowly-fugative, non-tackifying, release-type plasticizer, which migrates more-or-less continuously to the uppermost surface 160 of the game board, thereby assuring that the coacting normally-tacky, more-or-less permanently pressure-sensitive adhesive 170 that is used by the player to attach the game cards 180 adheres or bonds only temporarily or peelably or at reduced adhesiveness when the cards are affixed to the game board, thereby again imparting the advantageous, temporarily-held-in-place adhesion/release feature of the instant invention.

In yet another embodiment, again referring to FIG. 3, a coacting set of materials are employed in a manner similar to that first described in reference to FIG. 3 except that the slowly migrating fugative additive to the varnish coating 150 is selected such that it also acts as a tackifying agent for an otherwise non-tacky, non-adhesive or latently-adhesive liquid 170 that is supplied with the game board for application by the player to the game cards 180, said fugative additive upon migrating to the game board playing surface 160, renders said latent liquid adhesive sufficiently tacky or adhesive upon contact of the coacting pair to hold the game cards fixedly but peelably in place during the play of the game. The latent adhesive liquid and the fugative additive may be selected by those skilled in the art so that the bond strength resulting from their coaction is sufficient to allow peelable release of the game cards together with the adhesive 170 that was formed by coaction of the material pair from the game board coated playing surface 160, substantially as shown in FIG. 3, thereby restoring the game board surface 160 to a non-adhesive condition for foldable storage and subsequent reuse.

Permanent Tacky Surface Layer

Figure 5:
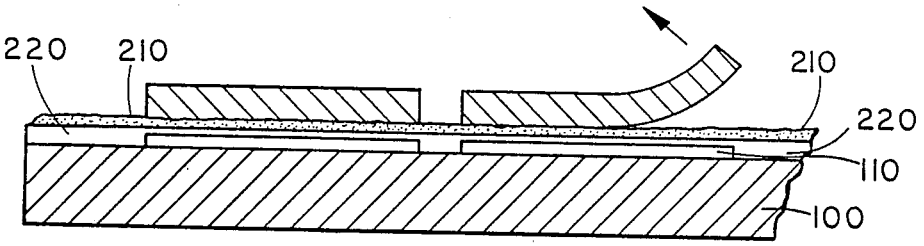
FIG. 5 is a sectional view of another embodiment of the invention disclosed herein.
Figure 6:
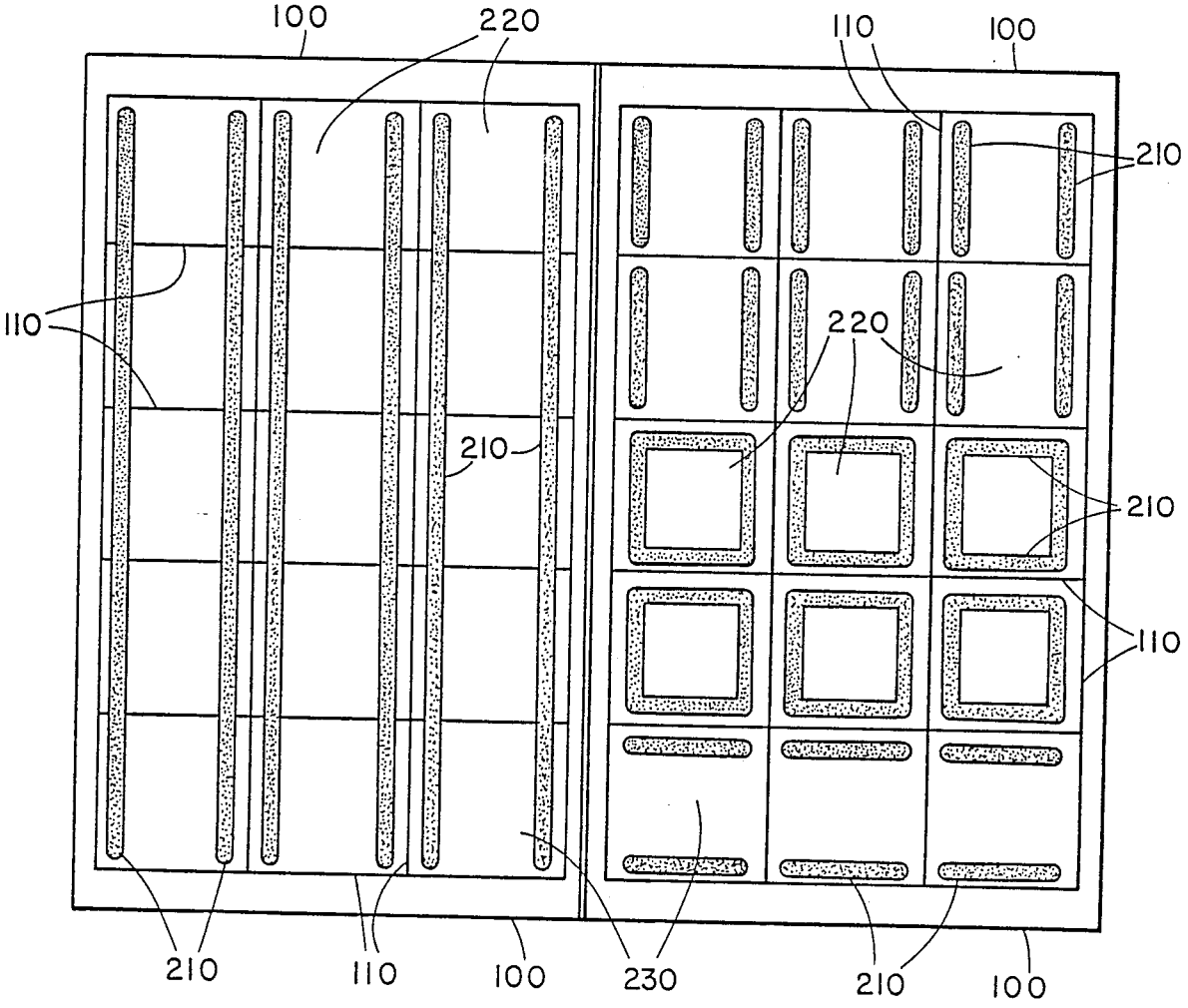
FIG. 6 is a top view of the embodiment shown in section in FIG. 5.

In another embodiment of this invention, shown in FIGS. 4, 5 and 6, a game board 100 is provided with a permanently tacky or adhesive surface layer 210, somewhat similar to that found on cellophane pressure-sensitive tapes or on pressure-sensitive labels, said layer 210 being applied over an intermediate protective varnish layer 220. Supplied with the game board is a protective peelably-separable release-coated paper or other relatively thin sheet 200 (FIG. 4) that is removed from the game board's tacky surface prior to using the board in the play of the game, thereby allowing the game cards to be fixedly secured temporarily to the game board without necessity for the game player to handle a separate liquid adhesive. It will be apparent in the practice of this invention that the pressure-sensitive adhesive 210 of FIG. 5 is selected to have low permanent bond to or adhesiveness for the usually-paper game cards and to have a high cohesive strength and high adhesiveness for the game board surface coating 220, thereby allowing the game cards to be intentionally and willfuly peeled completely from their adhesively-fixed positions without removal of the adhesive 210 from the game board surface, which thereby renders the game board ready to receive a new set of game cards. During storage the release sheet 200 is placed against the game board surface to disallow bonding between the facing game board surfaces, as illustrated in FIG. 4.

Advantageously, the game board can be manufactured with the tacky adhesive material applied only in lines or patterns sufficient to hold the individual game cards in place, for example as illustrated in FIG. 6.

Static Charge Adhesion

Figure 7:
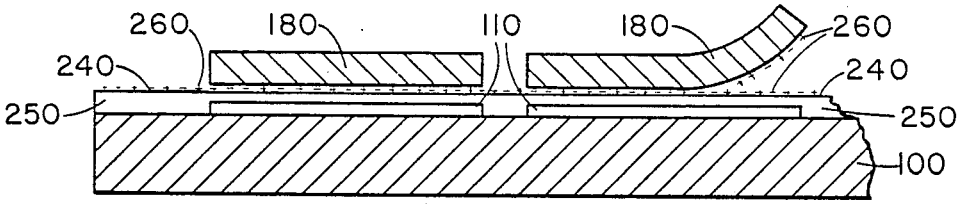
FIG. 7 is a sectional view of yet another embodiment of the invention.

A further embodiment, shown in FIG. 7, provides for a printed game board 100 coated with an electrically nonconducting or poorly-conducting material 240 over a typical clear varnish overcoating 250, or sufficient dielectric material is included in the varnish 250 to impart the property of readily developing and retaining more-or-less permanent static surface charges 260 as depicted in FIG. 7, for instance by rubbing said dielectric material 240 and 250 with a cloth. The varnish may be selected from among dielectric materials well-known in the art of coatings such as polyvinylidene chloride or polystyrene and the like. In this embodiment the static surface charges 260 on the game board serve to hold the inherently poorly-conducting paper game cards 180 in place during play of the game, thereby avoiding the disadvantages associated with the use of latent liquid adhesives, previously-applied adhesives or player-applied adhesives or pressure-sensitive tapes and the like, yet retaining the temporarily-affixed, peelably removable game cards of this invention.

Adhesion Via Liquid Surface Migration

Figure 8:
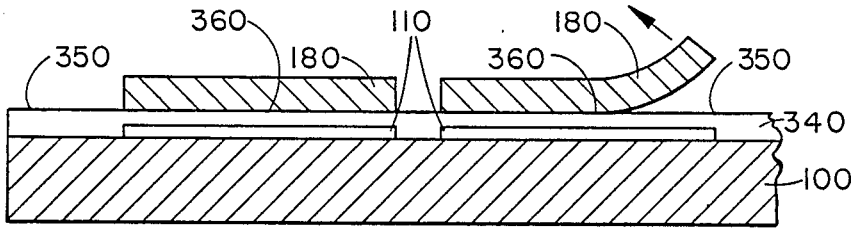
FIGS. 8, 9, and 10 are sectional views of certain other embodiments of the invention.
Figure 9:
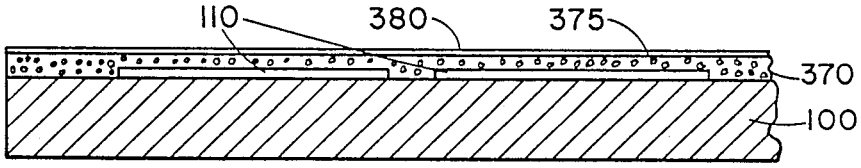
Figure 10:
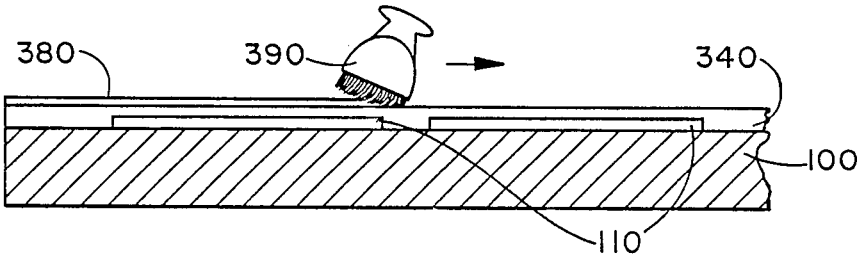

Another embodiment of this invention, shown in FIGS. 8, 9 and 10, comprises game board sections 100, illustrated or printed 110 on the playing-surface side of the board, the printed surfaces being overcoated with a varnish or organic polymer coating 340 which coating or varnish contains sufficient liquid, fugative, non-adhesive, non-evaporating viscous additive that said liquid tends to accumulate by fugative migration at the surface of coating 30, forming a thin uniform liquid film 350 thereon. Said liquid film coacts with the normally porous, fibrous, rough-surfaced reverse side of the game game cards 180 by capillary attraction, thereby forming a temporary adhesive bond 360 between the game cards 180 and the coacting exudated material on surface 350.

The exudable or fugative liquid of this embodiment may be selected by those skilled in the art to be non-toxic and non-allergenic and rather highly-cohesive so that its penetration into the playing card fiber surfaces is limited thereby avoiding premature exhaustion of its surface concentration.

Upon willful peelable removal of the game cards 180 from the game board surface 350, substantially all of the viscous liquid, wetting, capillary-adhesive material remains in the varnish 340 or at the varnish surface 350 thereby rendering the playing surface ready to receive a new set of cards. Liquids appropriate for this embodiment may advantageously be selected from liquid polymeric materials such as low molecular weight hydrocarbons or waxes, polybutenes, low-softening point petroleum or synthetic waxes and the like and mixtures of these illustrative materials of this type are Norchem 70 petroleum hydrocarbon resin of 72° C. softening point, Nevillac 10 hydroxy modified resin of softening point 10° C., and the Unichlor series of chlorinated paraffins, all available from Neville Chemical Company, Pittsburgh, PA.

In practice, not all of the exudable capillary-acting adhesive material may remain with the game board, some of it being removed with removal of the game cards or by inadvertent loss during use or storage, thereby becoming depleted to below a quantity affording the above-described adhesive effectiveness.

Conveniently, to avoid this disadvantage, the latent adhesive liquid can be contained within the overprint coating 370 in the form of pressure-sensitive capsules 375, as shown in FIG. 9, or as an additional coating 380 applied to the protective varnish coating, as shown in FIG. 10, thereby forming a large reservoir of said latent adhesive liquid. When game cards 180 are pressed against the game board surface 380, the latent liquid capillary adhesive temporarily bonds the cards to the board.

Alternately, as shown in FIG. 4, said latently-adhesive liquid can be contained as a fugative impregnant in a paper or similarly-porous slip sheet 200, which is placed between folded game board surfaces to furnish and/or replenish the latent adhesive to the coated board surfaces.

Yet another alternative of this embodiment is to furnish a wipe-on dispenser 390 (shown in FIG. 10) with the game board, such a dispenser containing the equivalent of multiple applications of the latent fluid capillary-adhesive to the game board surface. Application as in FIG. 10 prior to game play renders the coated surface 340 latently adhesive.

A further alternative replaces coating 380 of FIG. 10 with a continuous stamp-pad type of coating filled with the aforementioned latent liquid adhesive, which alternative embodiment functions similarly to the alternative utilizing microcapsules 375, shown in FIG. 9.

While the apparatus hereinbefore described is effectively adapted to fulfill the aforesaid objects, it is to be understood that the invention is not intended to be confined to the particular preferred embodiments of peelably adhesive game board herein set forth. Rather, the invention is to be taken as including various equivalents without departing from the scope of the appended claims.

What is claimed is:

1. A game board for holding a plurality of game cards fixedly in view of a player, comprising:

a plurality of rigid board elements, foldable together, having hinge means provided therebetween, and printed to illustrate advantageous positioning of game cards on the upper surfaces of said elements; and a polymeric coating substantially coextensively applied to the printed surfaces of said elements;

said polymeric coating containing materials that adhesively coact with the game cards directly thereby adhering the game cards to the printed surfaces;

said adhesively coacting materials being selected to render the game cards peelably removable together with the adhesiveness that was coactively created, thereby rendering the surface of said board elements substantially unchanged from their original latently coactive adhesive condition and thereby providing multiple peelable affixation and reuse cycles of game cards to said board elements.

2. A game board as recited in claim 1 wherein the adhesively coacting materials contained in said polymeric coating are dielectric materials which give said coating the property of readily developing and retaining static surface charges, said charges temporarily and peelably adhering the game cards to the printed surfaces of said board elements.

3. A game board as recited in claim 2 wherein said dielectric materials are chosen from the group consisting of polyvinylidene chloride and polystyrene.

4. A game board as recited in claim 1 wherein the adhesively coacting material contained in said polymeric coating is a fugative, non-adhesive, non-evaporating viscous liquid which tends to accumulate by fugative migration at the surface of said coating, which liquid coacts with the reverse side of the game cards to form a temporary, peelable adhesive bond.

5. A game board as recited in claim 4 wherein said liquid is contained in pressure-sensitive capsules within said coating, said capsules releasing some of said liquid when game cards are pressed against said board elements.

6. A game board as reicted in claim 4 further comprising a porous sheet impregnated with said liquid, inserted between said board elements when in their folded position, for replenishing said liquid in said polymeric coating.

7. A game board as recited in claim 4 wherein said liquid is replenished by means of external reapplication of said liquid to the surface by the game player.

8. A game board for holding a plurality of game cards fixedly in view of a player, comprising:

a plurality of rigid board elements, foldable together, having hinge means provided therebetween, and printed to illustrate advantageous positioning of game cards on the upper surfaces of said elements;

a polymeric coating substantially coextensively applied to the printed surfaces of said elements; and a permanently tacky surface layer, applied over said polymeric coating, allowing game cards to be temporarily, peelably secured to said board elements without the player handling any separate adhesive.

9. A game board as recited in claim 8 further comprising a peelably-separable, release-coated sheet placed between said board elements when in their folded position, for protecting said permanently tacky surface layer and disallowing bonding during storage.

10. A game board as recited in claim 9 wherein said permanently tacky surface layer is applied only in lines and patterns sufficient to hold the game cards in place.

* * * * *